US009159274B2

(12) United States Patent
Rhodes et al.

(10) Patent No.: US 9,159,274 B2
(45) Date of Patent: Oct. 13, 2015

(54) DRIVER FOR PAGE TRANSITIONS IN AN ELECTRONIC PAPER DEVICE

(75) Inventors: Bradley J. Rhodes, Alameda, CA (US); Guotong Feng, San Jose, CA (US); Edward L. Schwartz, Sunnyvale, CA (US)

(73) Assignee: Ricoh Co., Ltd., Tokyo (JP)

( * ) Notice: Subject to any disclaimer, the term of this patent is extended or adjusted under 35 U.S.C. 154(b) by 458 days.

(21) Appl. No.: 13/042,450

(22) Filed: Mar. 7, 2011

(65) Prior Publication Data

US 2012/0229436 A1 Sep. 13, 2012

(51) Int. Cl.
*G09G 3/20* (2006.01)
*G09G 3/34* (2006.01)

(52) U.S. Cl.
CPC ..... *G09G 3/344* (2013.01); *G09G 3/2007* (2013.01); *G09G 2310/06* (2013.01); *G09G 2340/16* (2013.01)

(58) Field of Classification Search
CPC .. G09G 3/344; G09G 3/2007; G09G 2340/16
USPC ..... 345/94, 107, 208, 545–551
See application file for complete search history.

(56) References Cited

U.S. PATENT DOCUMENTS

| | | | | |
|---|---|---|---|---|
| 5,638,533 | A * | 6/1997 | Law | 711/157 |
| 2002/0109698 | A1* | 8/2002 | Champion et al. | 345/545 |
| 2003/0137521 | A1* | 7/2003 | Zehner et al. | 345/589 |
| 2008/0309953 | A1* | 12/2008 | Feng | 358/1.9 |
| 2009/0256868 | A1* | 10/2009 | Low et al. | 345/691 |
| 2011/0001764 | A1* | 1/2011 | Rhodes | 345/690 |

* cited by examiner

*Primary Examiner* — Matthew Fry
(74) *Attorney, Agent, or Firm* — Patent Law Works LLP

(57) ABSTRACT

A system and a method for updating an electronic paper display are disclosed. A memory includes a waveform table and a transition matrix including multiple pixels, each representing a pixel of the electronic paper display. A page transition display system is coupled to the memory and identifies waveforms from the waveform table associated with multiple transition matrix pixels by processing multiple transition matrix pixels in parallel. For example, the page transition display system loads multiple transition matrix pixels into a register and accesses the waveform table using the contents of the register. Using the identified waveforms, the page transition display system generates control signals used to modify the electronic paper device.

20 Claims, 8 Drawing Sheets

DRIVER FOR PAGE TRANSITIONS IN AN ELECTRONIC PAPER DEVICE

BACKGROUND OF THE INVENTION

1. Field of Art

The disclosure generally relates to the field of electronic paper displays, and more specifically relates to displaying a page transition on electronic paper displays.

2. Description of the Related Art

Several technologies have been introduced recently that provide some of the properties of paper in a display that can be updated electronically. Some of the desirable properties of paper that this type of display tries to achieve include: low power consumption, flexibility, wide viewing angle, low cost, light weight, high resolution, high contrast and readability indoors and outdoors. Because these types of displays attempt to mimic the characteristics of paper, they are referred to as electronic paper displays (EPDs) in this application. Other names for this type of display include: paper-like displays, zero power displays, e-paper and bi-stable displays.

A comparison of EPDs to Cathode Ray Tube (CRT) displays or Liquid Crystal Displays (LCDs) reveal that in general, EPDs require less power and have higher spatial resolution; however, many EPDs have lower update rates, less accurate color control and lower color resolution than LCDs or CRTs.

In a conventional LCD, the luminance, or color, of a pixel depends on the voltage applied to the pixel, with a given voltage corresponding to a specific luminance. In contrast, the luminance or color of a pixel in an EPD typically changes as voltage is applied to the pixel. For example, in some EPDs, applying a negative voltage to a pixel makes the pixel lighter (i.e., makes the pixel have a higher luminance) and applying a positive voltage makes the pixel darker. The higher the voltage and the longer or more frequently that voltage is applied, the larger the change in luminance. Hence, electronic paper displays are typically controlled by applying a sequence of voltages to a pixel instead of applying a single voltage to a pixel, like a typical LCD. Often, a sequence of voltages applied to an EPD pixel is referred to as a "waveform."

Additionally, control signals driving a pixel of an EPD also depend on the optical state to which the pixel is being driven and on the optical state from which the pixel is being driven. Other factors, such as temperature of the EPD, optical state of the pixel prior to the current optical state and the time since the pixel was last driven, are also taken into consideration when identifying a waveform to drive a pixel of an EPD.

Accordingly, conventional controllers for driving an EPD are often configured like an indexed color-mapped display. For example, a frame buffer of an electronic paper display includes indices to a waveform used to update an image rather than the waveform itself. When the optical state of a pixel is to be changed, the index of the appropriate waveform is chosen based on one or more factors, such as current pixel state and/or destination pixel state and the pixel's location in the frame buffer is set to the index corresponding to the chosen waveform.

It generally takes longer to apply a waveform to modify a pixel of an EPD than it does to modify a pixel of a conventional CRT or LCD display. This can lead to noticeable latency between when an application requests display of a new image on an EPD and when the EPD displays the new image. For example, an EPD using a conventional display controller may take 0.5 seconds to update a 1200×825 display. The latency can be reduced by simplifying the waveform calculation, for example by ignoring secondary factors such as dwell time and pixel history (prior displayed colors for the pixel) prior to the current optical state. However, but such simplifications to waveform calculation can result in remnants of prior displayed images remaining visible, a problem commonly referred to as "ghosting," when the EPD is modified.

While current update times are generally sufficient for the page turning needed by electronic books, they are problematic for interactive applications seeking to emulate page transitions or page flipping at higher speeds. A user may tolerate waiting for a second or two for transitioning between two pages when the user spends a few minutes reading each page. However, if a user wants to flip through numerous pages successively without spending more than a few seconds on each page, the increased latency of EPD modification becomes unacceptable.

SUMMARY OF THE INVENTION

The present invention overcomes the deficiencies and limitations of the prior art, at least in part, by a method for updating the display of an electronic paper device. In one embodiment, the system updating the electronic paper device comprises a memory storing a transition matrix and a waveform table. The transition matrix includes a plurality of transition matrix pixels. A page transition display system is coupled to the memory and identifies waveforms from the waveform table associated with a plurality of transition matrix pixels from the transition matrix. The page transition display system processes the plurality of transition matrix pixels from the transition matrix in parallel. For example the page transition display system applies one or more single instruction multiple data instructions to a plurality of transition matrix pixels to identify the waveforms associated with each of the plurality of transition matrix pixels in parallel. The page transition display system also generates control signals corresponding to the waveforms associated with the plurality of transition matrix pixels. In one embodiment, the control signals are communicated from the page transition display system memory buffer to a display subsystem that generates driving voltages based on the received control signals and applies the driving voltages to different pixels included in the electronic paper display device.

In one embodiment, the page transition display system comprises a subframe producer and a subframe consumer. The subframe producer is coupled to the memory and processes a plurality of transition matrix pixels in parallel to identify waveforms from the waveform table for modifying pixels in the electronic paper display device corresponding to transition matrix pixels. The subframe producer further generates a subframe associating an identified waveform with a corresponding transition matrix pixel. The subframe consumer is coupled to the subframe producer and controls a display subsystem that receives the subframe data from the subframe buffer.

The features and advantages described herein are not all-inclusive and many additional features and advantages will be apparent to one of ordinary skill in the art in view of the figures and description. Moreover, it should be noted that the language used in the specification has been principally selected for readability and instructional purposes, and not to limit the scope of the inventive subject matter.

BRIEF DESCRIPTION OF THE DRAWINGS

The invention is illustrated by way of example, and not by way of limitation in the figures of the accompanying drawings in which like reference numerals are used to refer to similar elements.

Figure 1:
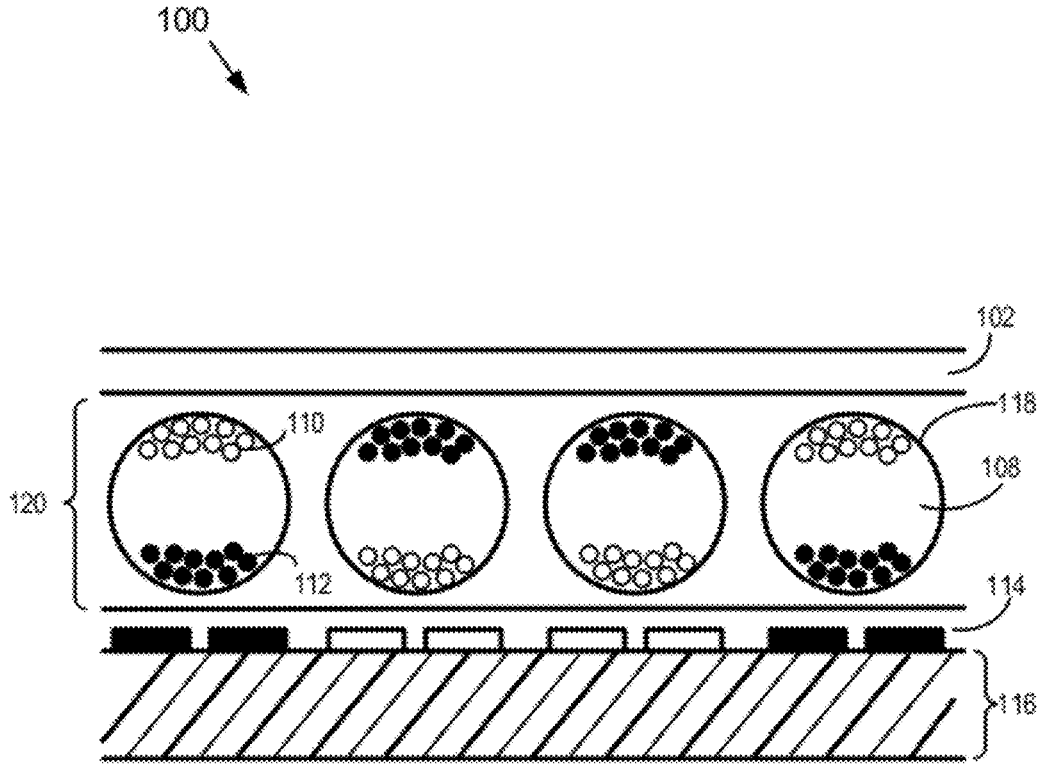
FIG. 1 is a cross-sectional view of a portion of an example electronic paper display.

The Figures depict various embodiments of the present invention for purposes of illustration only. One skilled in the art will readily recognize from the following discussion that alternative embodiments of the structures and methods illustrated herein may be employed without departing from the principles of the invention described herein.

DETAILED DESCRIPTION

A system and method for transitioning between pages using an electronic paper display (EPD) are described. In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention. For example, the present embodiment of invention is described in one embodiment below with reference to portable computing devices that are exemplified in a hardware and software platform using electronic paper, e-paper or electronic ink display. However, the present embodiment of invention applies to any type of portable computing device that can capture ink, data and commands, and send documents electronically.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment. In particular the present embodiment of invention is described below in the content of two distinct architectures and some of the components are operable in both architectures while others are not.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present embodiment of invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

The invention can take the form of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the form of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output or I/O devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the present embodiment of invention is described with reference to a particular programming language. It will be appreciated that a variety of programming languages may be used to implement the teachings of the invention as described herein.

Electronic Paper Device Overview

FIG. 1 illustrates a cross-sectional view of an example electronic paper display (EPD) 100, also referred to herein as a "display device 100." The EPD 100 comprises a transparent electrode 102 and a backplane 116 with a microcapsule layer 120 below the transparent electrode 102 and above the backplane 116. The transparent electrode 102 is a thin layer of transparent material allowing a user to view microcapsules 118 included in the microcapsule layer 120. In one embodiment, the top transparent electrode 102 also includes a transparent conductive material such as indium tin oxide.

In one embodiment, the microcapsule layer 120 includes closely packed microcapsules 118 that include a clear fluid 108, such as a clear liquid polymer. A microcapsule includes first particles 112 and second particles 110 suspended in the clear fluid 108. In one embodiment, the first particles 112 are black in color and the second particles 110 are white in color. Additionally, the first particles 112 have a first polarity and the second particles 112 have a second polarity. For example, a microcapsule 118 includes positively charged second particles 110 and negatively charged first particles 112. As another example, a microcapsule 118 includes positively charged first particles 112 and negatively charged second particles 110.

The electrode layer 114 is located below the microcapsule layer 120 and below the transparent electrode 102. The electrode layer 114 is a network of electrodes used to drive one or more microcapsules 118 to different optical states. For example, the electrodes apply waveforms to a microcapsule to change the color of the microcapsule 118. The network of electrodes is coupled to display circuitry, such as a display subsystem 360 and a timing interface 370, which modifies the appearance of pixels of the EPD by applying voltage to specific electrodes. In one embodiment, applying a negative charge to the electrode repels negatively charged first particles 112 in a microcapsule 118 away from the electrode layer 114 and toward the transparent electrode 102 and attracts positively charged second particles 110 in the microcapsule 118 to the electrode layer 114; if the first particles 112 have a black color and the second particles 110 have a white color, this gives a pixel including the microcapsule 118 a black appearance. In the preceding example, applying a positive voltage to the electrode repels positively charged second particles 110 in a microcapsule 118 away from the electrode layer 114 and toward the transparent electrode 102 and attracts negatively charged first particles 112 in the microcapsule 118 to the electrode layer 114; if the first particles 112 have a black color and the second particles 110 have a white color, this gives a pixel including the microcapsule 118 a white appearance. Thus, the luminance of a pixel in an EPD 100 changes in response to the voltage applied to an electrode. In one embodiment, the amount of luminance change may depend on both the amount of voltage and the length of time for which it is applied, with zero voltage applied to an electrode leaving a pixel's luminance unchanged.

The microcapsules 118 included in the microcapsule layer 120 may be individually or collectively activated to a next optical state, such as black, white or gray. In some embodiments, the next optical state may be any other prescribed color. Different pixels associated with an electrode in the electrode layer 114 are associated with one or more microcapsules 118 included in the microcapsule layer 120.

The electrode layer 114 is positioned on a surface of a backplane 116, such as a plastic or ceramic backing layer. In other embodiments, the backplane 116 is a metal or glass backing layer. The electrode layer 114 includes an array of addressable pixel electrodes and supporting electronics. In one embodiment, the electrode layer 114 integrated with the backplane layer 116.

Figure 2A:
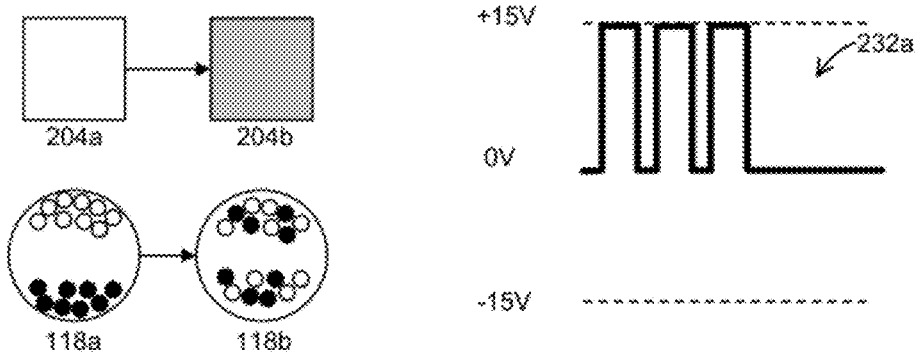
FIGS. 2A-2C are examples of modifying the optical state of one or more pixels in an electronic paper display.
Figure 2B:
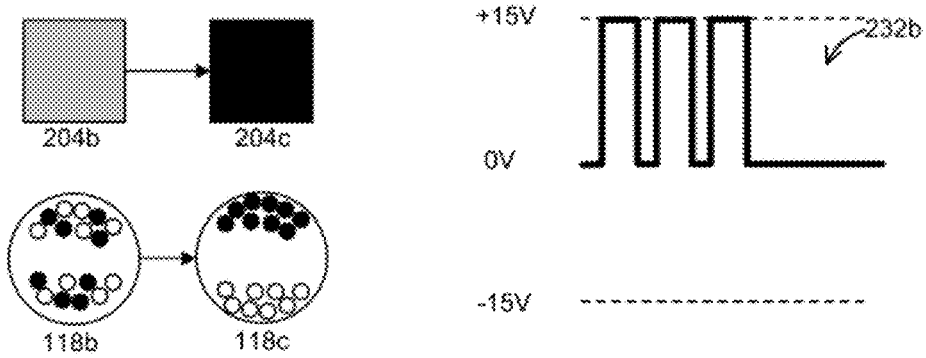
Figure 2C:
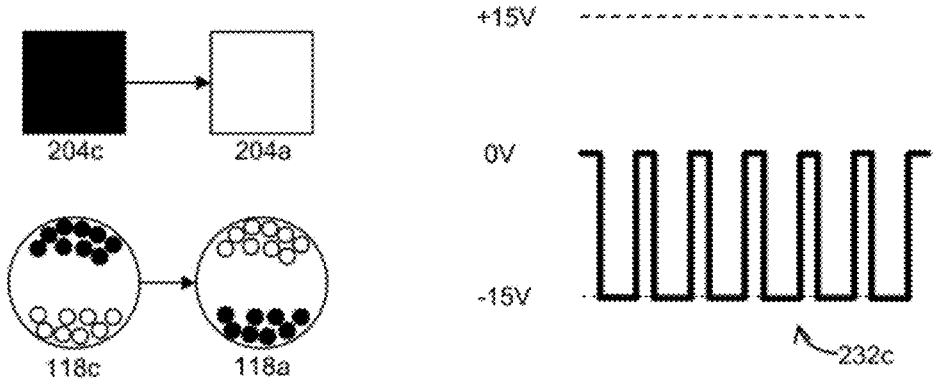

FIGS. 2A-2C are examples modification of the optical state of one or more pixels in an electronic paper display 100. The examples of FIGS. 2A-2C show movement of second particles 110 and first particles 112 in microcapsules 118 of an EPD 100 responsive to application of a waveform to an electrode. For purposes of illustration, FIGS. 2A-2C display examples of waveforms 232*a-c* applied to one or more microcapsules 118 by an electrode, or electrodes, in the electrode layer 114.

FIG. 2A illustrates a change in position of second particles 110 and first particles 112 in microcapsule 118 when electrode layer 114 applies an example waveform 232*a* where +15 volts are applied to an electrode for three subframes. Application of the example waveform 232*a* causes a subset of positively charged particles, such as the first particles 112, to move away from the electrode layer 114 and toward the transparent electrode 102. Similarly, a subset of negatively charged particles, such as second particles 110, move towards the positively charged electrode layer 114 and away from the transparent electrode 102 In one embodiment, the first particles 112 have a black color and the second particles 110 have a white color, so the movement of the first particles 112 and the second particles 110 causes a combination of first particles 112 and second particles 110 to be visible through the transparent electrode 102, resulting in a gray color 204*b* for a corresponding pixel. As discussed above, a microcapsule 118 maintains this state, or the gray color 204*b* of FIG. 2A, until another waveform is applied to an electrode proximate to the microcapsule 118.

FIG. 2B illustrates application of a second waveform 232*b* to the microcapsule 118 by an electrode in the electrode layer 114. In the example of FIG. 2B, the second waveform 232*b* is applied while the microcapsule 118 has a gray color 204*b*. In this example, the second waveform 232*b* applies +15 volts to the electrode for three subframes. This causes the remaining negatively charged second particles 110 to move towards the electrode layer 114 and the remaining positively charged first particles 112 to move towards the transparent electrode 102. As a result, the majority, or all, of the positively charged first particles 112 are visible through the transparent electrode 102. If the first particles 112 have a black color and the second particles 110 have a white color, the pixel color changes from gray 204*b* to black 204*c*.

FIG. 2C illustrates application of a third waveform 232*c* to the microcapsule 118 by an electrode in the electrode layer 114. In the example of FIG. 2C, the third waveform 232*c* applies −15 volts to an electrode for six subframes and is applied while the microcapsule 118 is in the black state of FIG. 2B. Application of the third waveform 232*c* moves the majority, or all, of the positively charged first particles 112 toward the electrode layer 114 and moves the majority, or all, of the negatively charged second particles 110 toward the transparent electrode 102. If the first particles 112 have a black color and the second particles 110 have a white color, the pixel color changes from black 204*c* to white 204*a*.

In the examples shown by FIGS. 2A-2C, application of +15 volts to an electrode for six subframes changes a pixel color from white 204*a* to black 204*c* while application of −15 volts to an electrode for six subframes changes the pixel color from black 204*c* to white 204*a*. In some embodiments, the waveform used to change a pixel from a first color to a second color is not the polar opposite of the waveform used to change the pixel from the second color back to the first color. Additionally, while FIGS. 2A-2C illustrate waveforms including positive voltages and zero voltages or including negative voltages and zero voltage, in other embodiments waveforms include any combination of positive voltages, negative voltages or zero voltage.

Additionally, the waveform subframes can each represent a time period, such as 20 milliseconds (ms). Accordingly, the time to change a pixel color from white 204*a* to black 204*c* is six subframes or 120 ms. This time is usually acceptable to a reader watching the transition of pixels as the user flips through pages on an electronic paper display. However, it typically takes longer to compute which voltage or waveform to apply to a pixel than it does to perform the corresponding operation on an EPD.

System Overview

Figure 3:
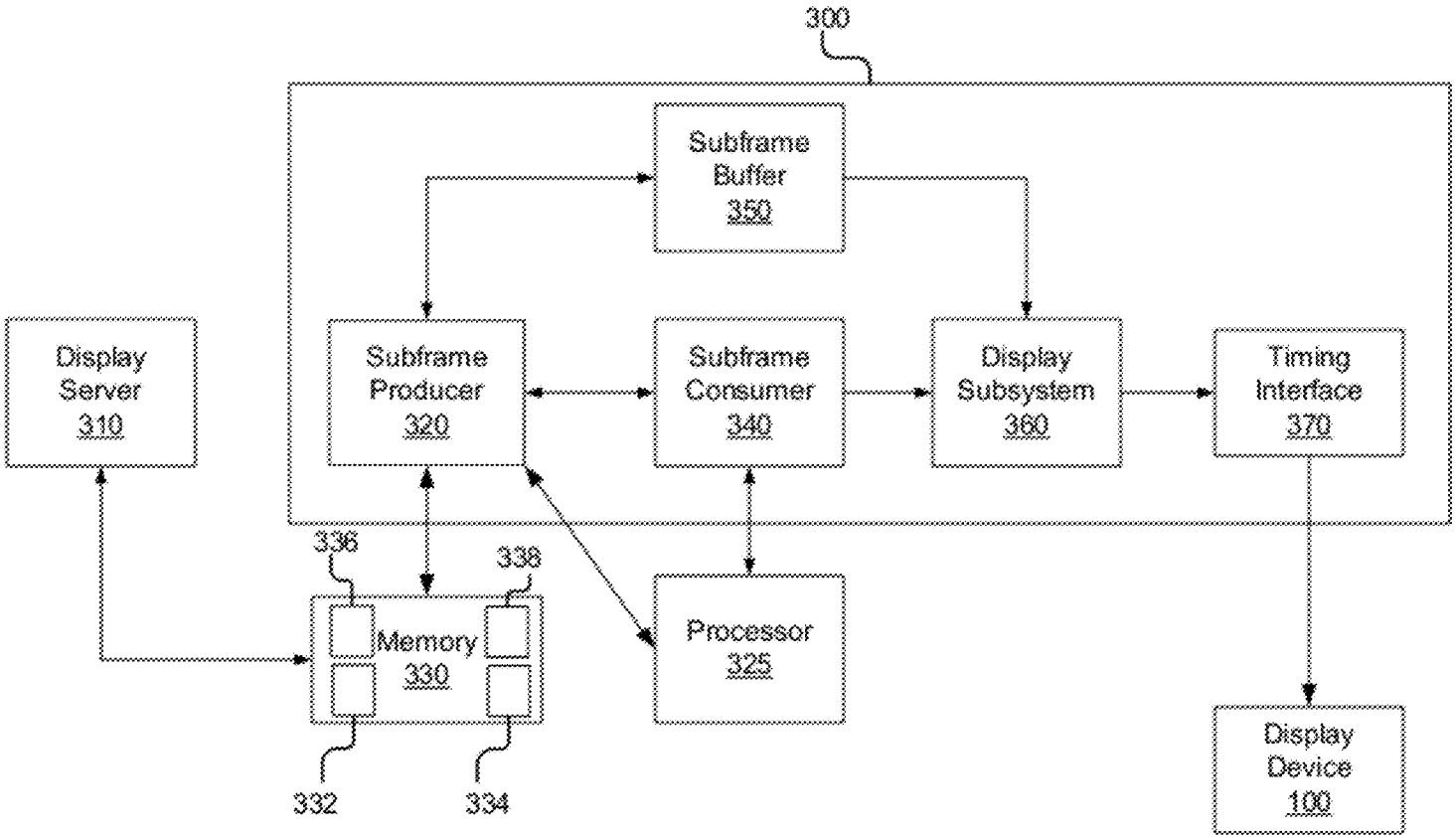
FIG. 3 is a block diagram of a display system according to one embodiment of the present invention.

FIG. 3 illustrates one embodiment of a page transition display system 300. In the system shown in FIG. 3, a display server 310 is coupled to the storage 312 and to a memory 330. The page transition display system 300 is coupled to the memory 330, a processor 325 and a display device 100, such as an EPD. In one embodiment, the page transition display system 300 comprises a subframe producer 320, a subframe buffer 350, a subframe consumer 340, a display subsystem and a timing interface 370.

The display server 310 receives user input and identifies a document or other data for presentation by the display device 110. For example, the display server 310 receives data identifying a document to be displayed from an application or from a user input. In one embodiment, the display server 310 receives a user input and determines a document, start page of the document from which the page transition starts, page transition speed and page transition direction. The display server 310 transmits the data to be displayed to the memory 330. For example, responsive to receiving an input to transition from a first page to a second page, the display server 310 transmits data describing the page transition and the second page to the memory 330.

The subframe producer 320 is communicatively coupled to a memory 330. The memory 330 is a computer-readable storage device such as a random access memory, a flash memory, a hard drive or another suitable storage device. A waveform table 332 is included in the memory 330. The waveform table 332 is an indexed storage for waveforms that are required to drive the display pixels on physical media 100 to desired colors. In one embodiment, the waveform table 332 is divided into a plurality of time periods represented by subframes and a cycle of waveform table 332 comprises subframes from first subframe to last subframe in waveform table 332. A subframe includes a part of the waveform required to drive the display pixel to a desired color. In one embodiment, the waveform table 332 includes a current subframe and a cycle number. The current subframe is the subframe in the waveform table 332 that is being currently read by the subframe producer 320. Similarly, the current cycle is the current cycle being read by the subframe producer 320. After the subframe producer 320 has read a complete cycle, the subframe producer 320 starts reading the next cycle. In other words, the subframe producer 320 starts reading the waveform table 332 from the first subframe again.

The indices in waveform table 332 are not permanently committed to a particular waveform and the indices are updated repeatedly with different waveforms required to drive the display pixels of a region of the display device 100 to a desired color. After the waveforms stored in waveform table 332 have been used to drive the display pixels, those waveforms are removed from the waveform table 332 and their indices are later updated with waveforms required to drive display pixels in another region of the display device 100. Indices that are not populated with a waveform in the waveform table 332 are assumed to correspond to a waveform consisting entirely of zeros, i.e. a waveform that specifies no change to a pixel during any subframe.

In one embodiment, the memory 330 also stores a transition matrix 334, which is a storage including transition matrix pixels corresponding to pixels on the display device 100. The display server 320 updates various transition matrix pixels of the transition matrix 334 with indices to waveforms required for driving the corresponding display pixels on the display device 100 to their desired color. The subframe producer 320 reads the transition matrix 334 to determine the index for a transition matrix pixel to determine an associated waveform from the waveform table 332. The determined waveform is applied to the corresponding display pixel on the display device 100 by the display subsystem 360 to drive the display pixel to its desired color.

In one embodiment, the memory 330 includes a waveform buffer 336, which is storage capable of storing a collection of indices and associated waveforms for driving one or more pixels in a region of the display device 100. The display server 310 stores waveforms for driving one or more pixels in a region of the display device in the waveform buffer 336. The display server 310 uses the information stored in the waveform buffer 336 to update the corresponding region of the transition matrix 334 with associated indices and to copy the waveforms and associated indices from the waveform buffer 336 and committed palette list 338. The display server 310 can reuse an index and its associated waveform in the waveform buffer 336 for updating multiple transition matrix pixels in the transition matrix 334 if all of those transition matrix pixels require the same waveform to be driven to their respective desired colors. After the waveform and associated indices are copied, the waveform buffer 336 is used to store the next set of waveforms and associated indices for another update region.

The committed palette list 338, included in the memory 330, is a storage used to track the expiration of waveforms in waveform table 332 once the waveforms for a particular display update region have been used. One of ordinary skill in the art will understand that committed palette list 338 can store the list of committed palettes in numerous ways like list, stacks, arrays etc. The committed palette list 338 is populated by the display server 310. The committed palette list 338 comprises a representation of one or more frame regions that are being updated, waveforms required to drive the display pixels in the display update region corresponding to the frame region, indices associated with the waveforms, and subframe and cycle number of the waveform table 332 at which the update to the display update region would be complete. Once the subframe producer 620 has generated control signals for applying the waveforms to the display device 100, the display server 310 removes from the committed palette list 338 information associated with the display update region such as representation of the corresponding frame region, waveforms for the frame region, associated indices, and update completion subframe and cycle number.

The subframe producer 320 is communicatively coupled to the display server 310 and to the memory 330. The subframe producer 320 accesses the memory 330 at a predetermined time interval to identify a waveform, or waveforms. In one embodiment, the subframe producer 320 identifies a waveform in parallel for application to each of the multiple pixels. For example, the subframe producer 320 applies one or more single instruction multiple-data (SIMD) instructions to process multiple input pixels as a vector to identify a waveform for each of the input pixels included in the vector. This parallel processing of multiple input pixels to identify waveforms in parallel is further described below in conjunction with FIG. 8 and operation of the subframe producer 320 is further described below in conjunction with FIG. 7.

For example, the subframe producer 320 accesses the memory 330 at 20 ms intervals to identify waveforms applied to multiple pixels in the display device 100 to modify the pixels from a current state to a next state. Using the identified waveforms and a transition block 404 from the memory 330, the subframe producer 320 generates subframes describing application of the identified waveforms to different pixels of the display device 100. Hence, as the subframe producer 320 identifies waveforms for application to the display device 100, subframes are generated and transmitted to the subframe buffer 350 for retrieval and application to the display device 100. In one embodiment, a subframe generated by the subframe producer 320 describes voltages which are applied to different pixels in the display device 100 to modify the state of the different pixels.

In one embodiment, the subframe producer 320 comprises data encoded on a computer readable storage medium that, when executed by a processor 325, causes the processor 325 to provide the functionality described herein. Thus, in one embodiment, the subframe producer 320 is a user space process executed by the processor 325. Implementation as a user space process reduces the overall cost of the system 300 while also reducing the complexity of designing the system 300. Additionally, implementing the subframe producer 320 as a process provides greater customization of how the display device 110 is controlled and simplifies modification of display device 110 control. Alternatively, the subframe producer 320 is a hardware device, such as an application specific integrated circuit (ASIC) or a field programmable gate array (FPGA).

The subframe buffer 350 is communicatively coupled to the subframe producer 320 and stores subframes received from the subframe producer 320. The subframe buffer 350 is a computer readable storage device, such as a random access memory, a flash memory, a hard drive or another suitable storage device, that stores the subframes received from the producer 340. Hence, the subframe buffer 350 includes the subframes identifying waveforms applied to different pixels of the display device 100 to modify the pixels of the display device 100. By storing the subframes, the subframe buffer 350 allows the subframe producer 320 to more quickly begin determining an additional subframe while the display device 100 is updated using the subframe, or subframes, stored by the subframe buffer 350. The subframe buffer 350 also expedites retrieval of a subframe by the subframe consumer 340 to expedite generation of control signals for modifying the display device 100.

The subframe consumer 340 is communicatively coupled to the subframe buffer 350 and to the display subsystem 360. The subframe consumer 340 controls the display subsystem 360, which uses the subframes stored in the subframe buffer 350 to generate control signals that are applied to the display device 110. In one embodiment, the control signals modify voltages of electrodes included in the display device to change the state of pixels of the display device 100. For example, the control signals from the display subsystem 360 change the color of pixels included in the display device 100. In one embodiment, the control signals from the display subsystem 360 modify the microcapsule layer 120 of an EPD, as described above in conjunction with FIGS. 1-2C.

In one embodiment, the subframe consumer 340 is a kernel space process executed by the processor 325. Implementation as a kernel space process reduces the overall cost of the system 300 while also reducing the complexity of designing the system 300. Additionally, implementing the subframe consumer 340 as a process, such as a kernel space process, provides greater customization of how the display device 110 is controlled and simplifies modification of display device 110 control. Alternatively, the subframe consumer 340 is a hardware device, such as an application specific integrated circuit (ASIC) or a field programmable gate array (FPGA).

In on embodiment, a timing interface 370 is coupled to the display subsystem 360 and to the display device 100 to modify the timing with which the control signals from the display subsystem 360 are applied to the display device 100. The timing interface 370 determines the timing of display device 110 modification and applies the voltages by performing operations specified by the display subsystem 360 at different times, allowing modification of the display device 100 as described above in conjunction with FIGS. 1-2C.

Method Overview

Figure 4:
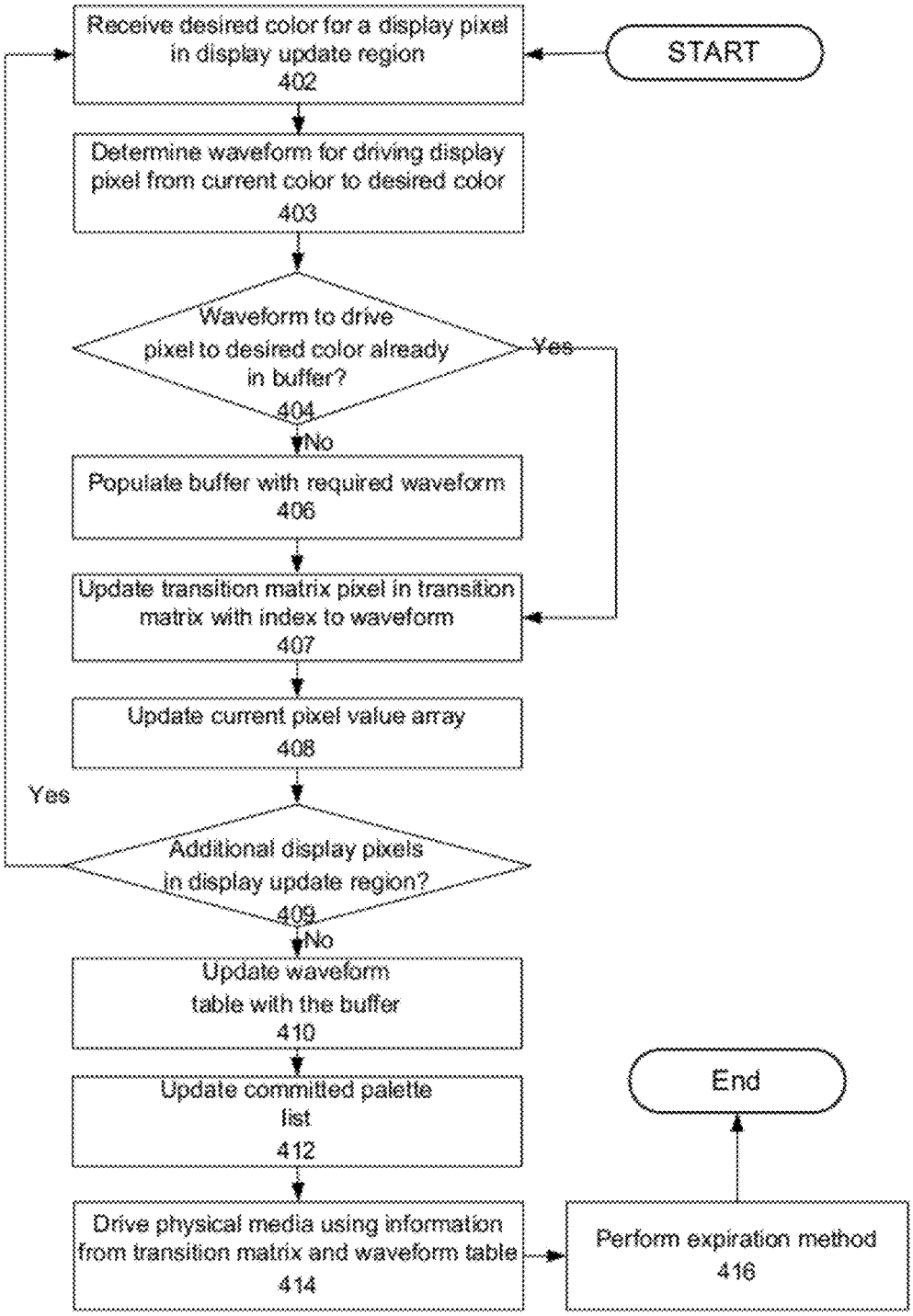
FIG. 4 is a flow chart of an embodiment of a method for driving one or more pixels of a display device according to one embodiment of the present invention.

FIG. 4 illustrates a flow chart describing the method used to drive one or more physical pixels in a display device 100 according to one embodiment of the invention. The display server 310 receives 402 the desired color for a display pixel in the display update region. Using the transition matrix pixel corresponding to the display pixel and the desired color for the display pixel, display server 310 determines a waveform to drive the display pixel from its current color to the desired color. In one embodiment, the display server 310 determines the current color for the display pixel from a stored array describing the current pixel value of multiple display pixels, retrieves or computes 403 the required waveform.

The display server 310 then determines 404 whether the required waveform is stored in a waveform buffer. For example the display server 320 determines 404 whether the computed required waveform has already been stored to the waveform buffer for another pixel. For the purposes of this determination, two waveforms are considered to be the same if they both comprise the same sequence of voltage pulses and both either interrupt the same waveform that is currently being driven or both do not interrupt another waveform. If the display server 610 has not already populated a waveform buffer with the same waveform for another pixel, the display server 610 populates 406 the waveform buffer with the required waveform and the index. Otherwise, the display server 610 skips populating the waveform buffer as the waveform is already stored in the waveform buffer.

Next, display server 310 updates 407 the transition matrix buffer pixel with index of the waveform in the waveform buffer and updates 408 a stored value associated with the display pixel to reflect the desired color. For example, the display server 310 determines updates a value in a stored array associated with the display pixel so that the desired color is associated with the display pixel. The display server 310 then determines 409 if multiple display pixels are being updated. For example, the display server 610 determines 409 if the display region being updated includes multiple display pixels. If multiple display pixels exist 609 in the display update region, steps 402-408 are repeated for those display pixels. If not, the display server 310 transfers 410 the waveforms from the waveform buffer 336 to corresponding indices in the waveform table 332. One embodiment of this method is described in more detail below with reference to FIG. 5.

When transferring 410 the waveform buffer to the waveform table 332, the display server 310 executes a locking process to prevent the subframe producer 320 from reading the waveform table 332 while the display server 310 is writing data. For example, the display server 310 locks a mutex shared with the producer while transferring 410 data, transfers 410 the data and then releases the lock. The subframe producer 320 similarly obtains the shared lock before incrementing the frame-cycle count value.

In one embodiment, the display server 310 updates palette transfer module 408 then updates 412 the committed palette list 338 with contents of the waveform buffer, the subframe region corresponding to display update region and frame-cycle count of waveform table 332 at which the update will complete. The subframe producer 320 then sets a flag or other data to indicate that display updates are pending so that the display pixels on the display device 100 are modified using the indices from the transition matrix 334 and corresponding waveforms from waveform table 332. After the update, the indices and corresponding waveforms expire and the display server 310 performs an expiration process, such as the one further described below in conjunction with FIG. 6.

Figure 5:
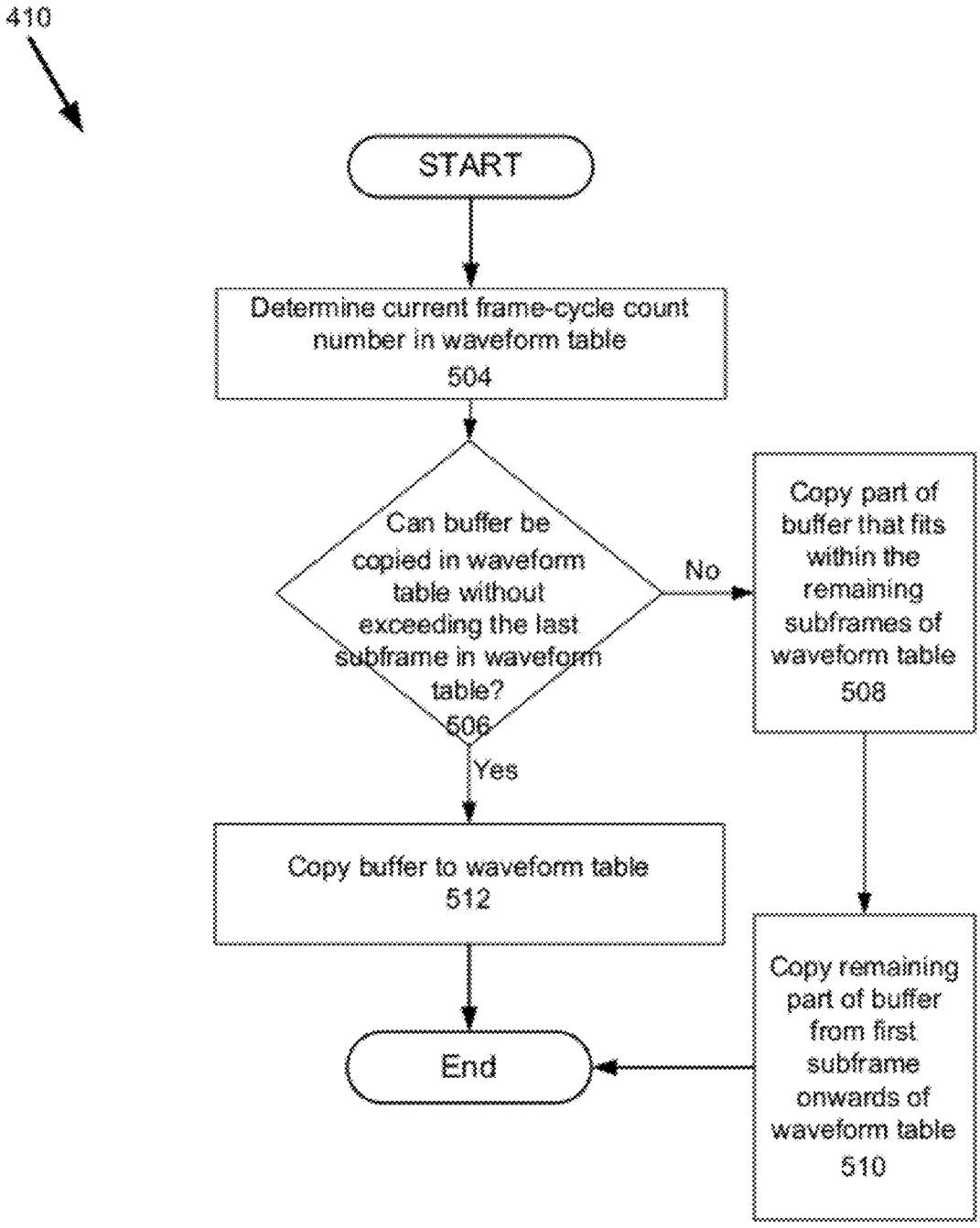
FIG. 5 is a flow chart of an embodiment of method for transferring contents of the waveform buffer to the waveform table according to one embodiment of the present invention.

FIG. 5 illustrates one embodiment of a method for transferring 410 contents of the waveform buffer 336 to the waveform table 332. The display server 310 determines 504 the current frame-cycle count in the waveform table 332 that is being read by the subframe producer 620.

The display server 310 then determines 506 if the longest waveform in the waveform buffer 336 is shorter than the remaining subframes in the current cycle of the waveform table 332. If the waveform buffer 336 includes an interrupting waveform, the display server 310 determines if the current frame in the waveform table 332 is already past the last subframe including pulses from the interrupted waveform. If yes, the display server 310 determines if the interrupting waveform would fit in the subframes remaining after the current subframe. If not, the display server 310 determines if the interrupting waveform would fit in the subframes remaining after the last subframe that includes the interrupting waveform.

If the longest waveform and the interrupting waveforms would fit into the current cycle, the display server 310 copies 512 waveforms from the waveform buffer 336 to the waveform table 332 starting at the subframe following the current subframe in the waveform table 332. In one embodiment, waveforms that drive interrupted pixels are copied from the waveform buffer 336 to the waveform table 332 at the index of the interrupting waveform (that is, the index to which part of the interrupted waveform was previously copied). The interrupting waveform is copied starting either at the subframe following the current subframe or at the subframe following the last subframe of the copied region of the interrupted waveform, whichever is later.

In the case where the current subframe is the last subframe in the waveform table 332, the following subframe is the first subframe of the waveform table 332. If the longest waveform in the waveform buffer 336 is not shorter than the remaining subframes in the current cycle of the waveform table 332, the display server 610 copies 508 parts of the waveforms to waveform table 332 starting at the subframe following current subframe until the last subframe in the current cycle of the waveform table 332. In one embodiment, parts of waveforms that drive interrupted pixels are copied from the waveform buffer 336 to the waveform table 332 starting either at the subframe following the current subframe or at the subframe following the last subframe of the copied region of the interrupted waveform, whichever is later. The display server 310 copies 510 the remaining parts of the waveforms from the first subframe onwards of the next cycle of the waveform table 332.

Figure 6:
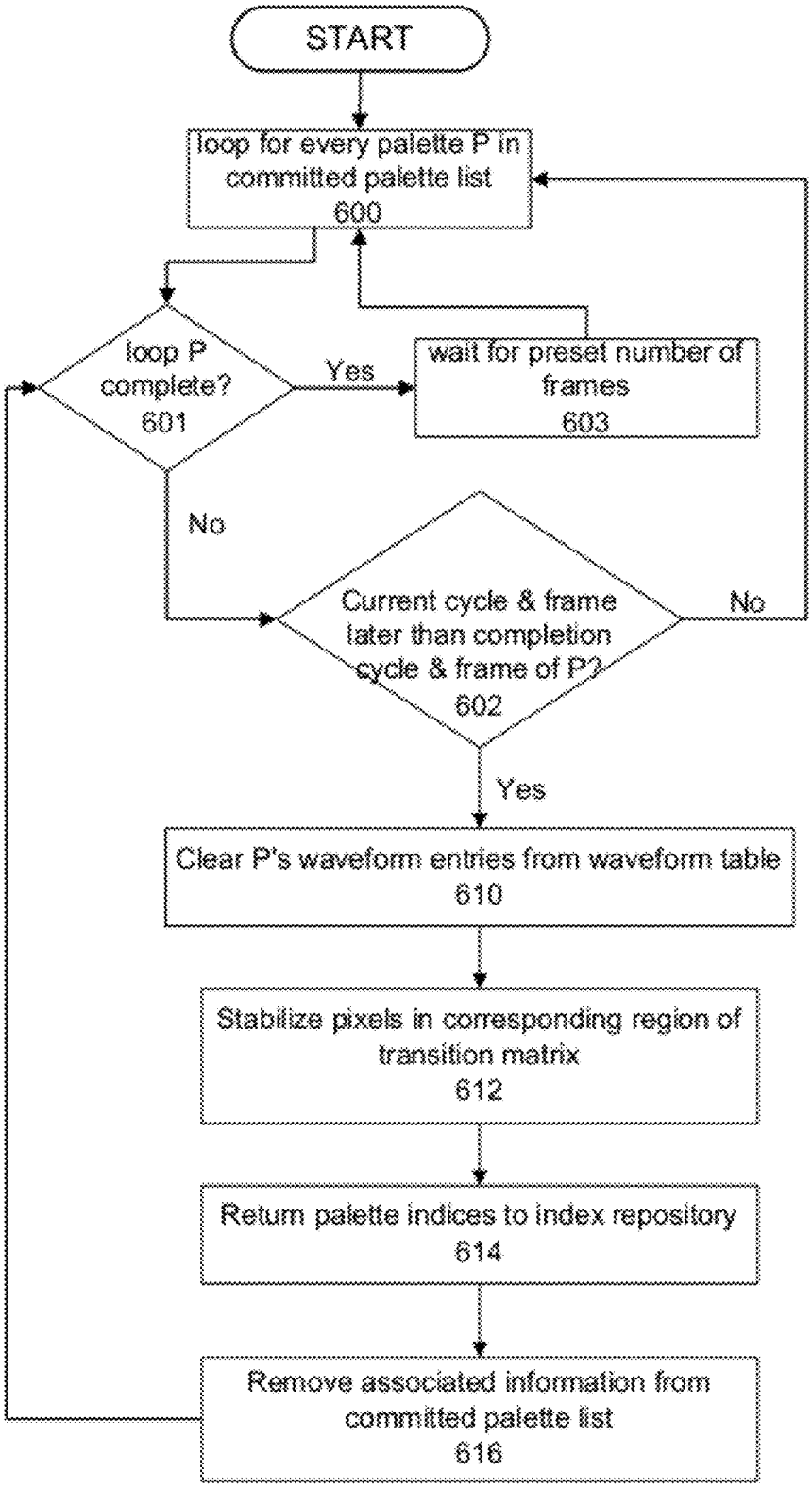
FIG. 6 is a flow chart of an embodiment of an expiration method performed by a display server according to one embodiment of the present invention.

FIG. 6 illustrates one embodiment of an expiration method performed by the display server 310. The display server 310 performs 600 a loop to examine each palette in the committed palette list 338. If all palettes in the committed palette list 338 have been examined 601, the display server 610 waits 603 for a preset period of time (typically on the order of a few subframes) and then repeats the loop over the palettes in the committed palette list 338. Otherwise, the display server 310 determines 602 whether the subframe producer 320 has completed reading the subframes from waveform table 332 that include the longest waveform in the examined palette. In other words, the display server 310 determines 602 if the palette has expired. To do so, the display server 310 determines 602 whether the current subframe of the current cycle in waveform table 332 is later than the completion cycle and subframe for the examined palette. This will be true if either the current cycle in the waveform table 332 is greater than the completion cycle of the examined palette, or if the current cycle number in the waveform table 332 is equal to the completion cycle of the examined palette and the frame-cycle count in waveform table 332 is greater than the completion frame of the examined palette. If neither case is true, the display server 610 jumps back to the start of the loop 600 and examines the next palette in the completed palette list 338. If the examined palette has expired, the display server 310 clears 610 the waveforms from waveform table 332 corresponding to the waveforms of the expired palette.

The display server 310 then stabilizes 612 the transition matrix pixels in the corresponding frame region. Next, the display server 310 returns 614 the indices associated with expired waveforms to a repository and removes 616 the information associated with the expired palette from the completed palette list 338. The display server 310 then jumps back to the start of loop 800 and examines the next palette in the completed palette list 338.

Figure 7:
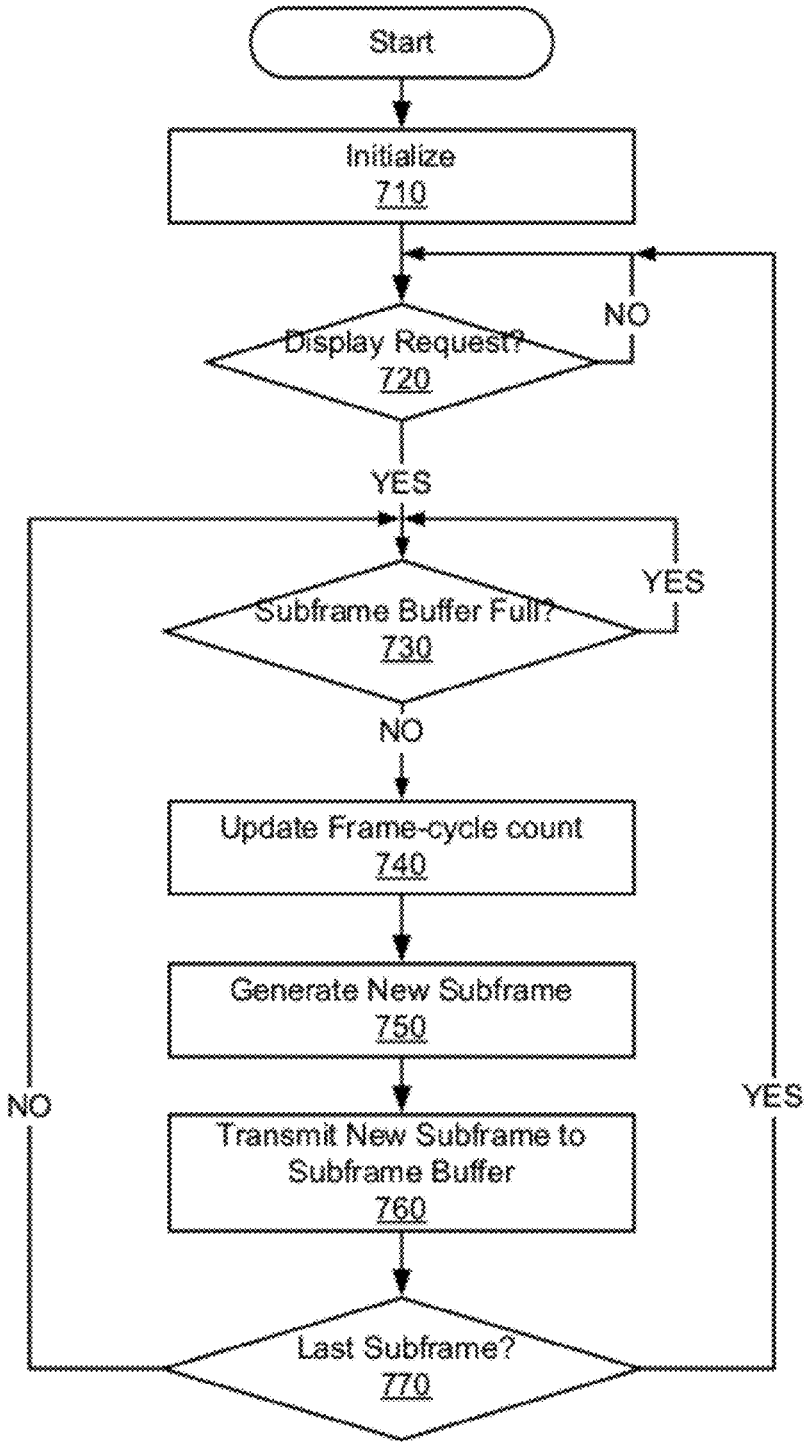
FIG. 7 is a flowchart of a method for updating subframes for modifying a display device according to one embodiment of the invention.

FIG. 7 illustrates one embodiment of a method of operation for a subframe producer 320. The subframe producer 320 is first initialized 710 to a default state. In the default state, the subframe producer 320 determines 720 whether the display needs to be updated. In one embodiment, the subframe producer 320 determines 720 whether a display request has been received from an application 310 or another service. For example, the subframe producer 320 communicates with the display server 310 at predefined intervals to determine 720 if a display request has been received. If the display does not need to be updated, the subframe producer 320 continues to determine 720 whether the display needs updating. For example, if no display request has been received, the subframe producer 320 continues to monitor for display requests from the display server 310 or another service. In another embodiment, the subframe producer 320 determines whether a display request has been received by examining a location in memory shared between the subframe producer 320 and the display server 310.

However, if the subframe producer 320 determines 720 that the display needs to be updated, the subframe producer 320 determines whether the subframe buffer 350 is full. For example, responsive to receiving a display request from an application 310 or other service, the subframe producer 320 accesses the subframe buffer 350 to determine 730 whether the subframe buffer 350 is full. If the subframe buffer 350 is full, the subframe producer 320 continues to access the subframe buffer 350 until it determines that the subframe buffer 350 is not full.

In response to determining 730 that the subframe buffer 350 is not full, the subframe producer 320 updates 740 a subframe counter to indicate that a new subframe is being added to the subframe buffer 350. Meanwhile, the subframe producer 320 locks, increments, and unlocks the frame cycle count which is to be read by the display server 310. After incrementing the subframe counter, the subframe producer 320 generates 750 a new subframe. In one embodiment, the subframe producer 320 generates 750 a new subframe by applying one or more instructions to multiple pixels, such as transition matrix pixels, from the transition matrix 334 to identify waveforms from the waveform table 332 corresponding to the different transition matrix pixels. For example, the subframe producer 320 applies one or more single instruction multiple-data (SIMD) instructions to a vector including a plurality of input pixels received from the transition matrix 334 to identify a waveform from the waveform table 332 associated with each of the plurality of input pixels included in the vector. One example of identifying a waveform associated with an input pixel is further described below in conjunction with FIG. 8. Parallel identification of waveforms for a plurality of input pixels allows the subframe producer 320 to more rapidly generate 750 a new subframe.

The new subframe is transmitted 760 to the subframe buffer 350 for storage. After transmitting 760 the new subframe to the subframe buffer 350, the subframe producer 320 determines 770 if the new subframe is the last subframe for updating the display for the current display request. If the new subframe is the last subframe, the subframe producer 320 resumes determining 720 whether to update the display. For example, the subframe producer 320 resumes determining 720 whether a display request is received from the application 310. If the new subframe is not the last subframe, the subframe producer 320 again determines whether the subframe buffer 350 is full and steps 730-770 are repeated as described above.

Figure 8:
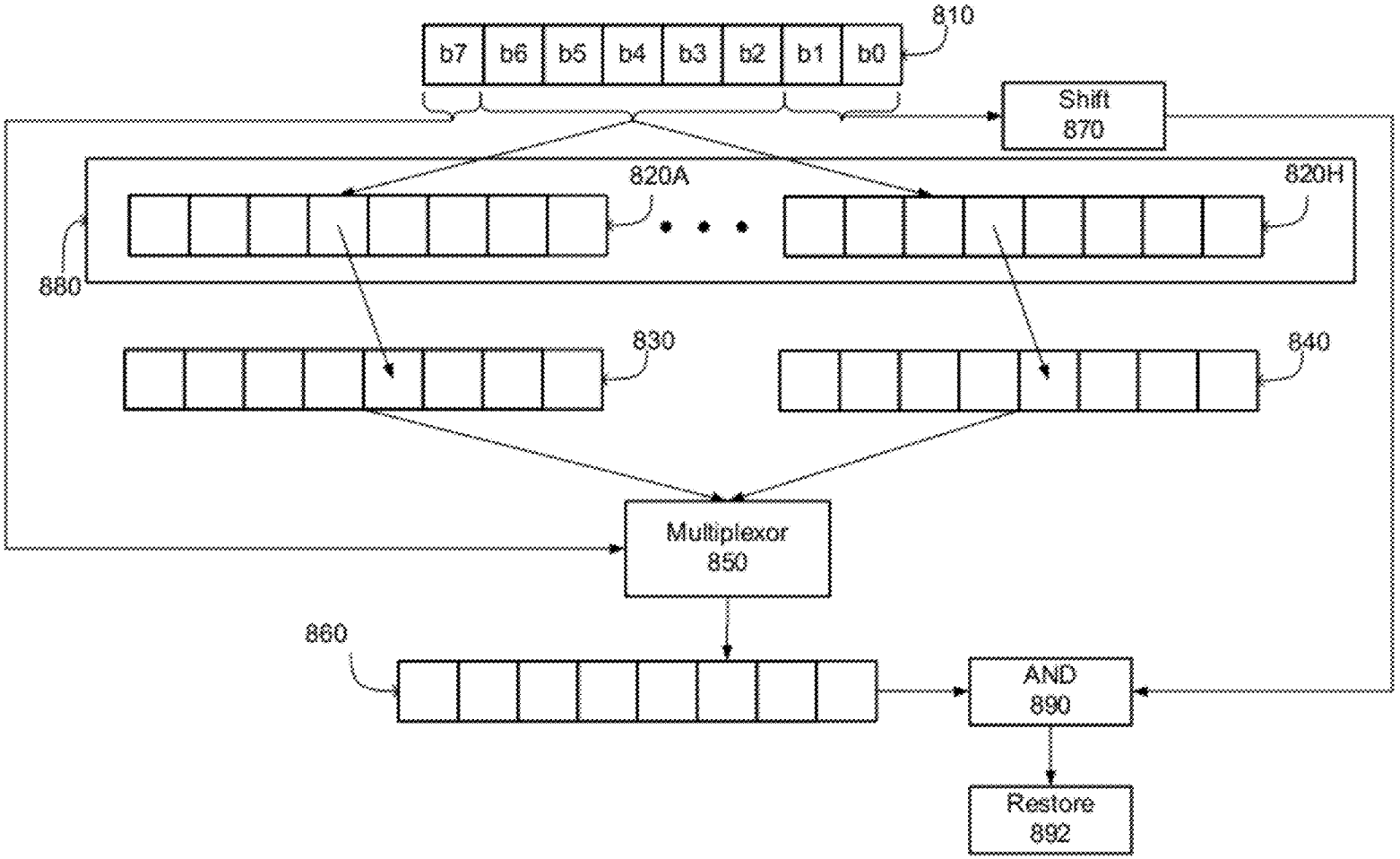
FIG. 8 is a functional diagram of a method for identifying a waveform for application to an input pixel during a subframe according to one embodiment of the invention.

FIG. 8 is a functional diagram of an example method for identifying a waveform associated with an input pixel. To simplify description, FIG. 8 shows waveform identification for a single input pixel. However, when implemented, the subframe producer 320 performs the steps described below in conjunction with FIG. 8 in parallel for multiple input pixels. For example, the subframe producer 320 performs the following actions in parallel for eight input pixels. Also, for purposes of illustration, FIG. 8 discusses an implementation where an input pixel is 8 bits; however, in other implementations, the input pixel can be a greater, or fewer, number of bits.

Initially, the subframe producer 320 loads multiple input pixels into an input register 810. In the example of FIG. 8, the subframe producer 320 loads eight input pixels into the input register 810. In the example of FIG. 8, each input pixel is 8 bits, so 8 bytes are initially loaded into the input register 810. In the example of FIG. 8, the data stored in the input register 810 is denoted as b7, b6, b5, b4, b3, b2, b1 and b0, with b7 indicating the most significant position of the input register 810 and b0 is the least significant position of the input register 810. The middle five positions of the input register 810—b6, b5, b4, b3 and b2—are communicated to a lookup table 880. Hence, the input pixels stored in b6, b5, b4, b3 and b2 are communicated to the lookup table 880.

In one embodiment, the lookup table 880 comprises registers 820A-820H. The subframe producer 320 uses one or more subsets of the middle five positions of the input buffer 810 to identify data from registers 820A-820H. In one embodiment, the subframe producer 320 identifies a first set of data from registers 820A-820D using the middle five positions of the input buffer 810 and stores the first set of data in a first register 830. The subframe producer 320 also identifies a second set of data from registers 820E-820H using the middle five positions of the input buffer 810. The second set of data identified from registers 820E-820H is then stored in a second register 840. Thus, a first set of data is identified using a subset of the input register 810 and a first portion of the lookup table 880, registers 820A-820D, and is stored in the first register 830 while a second set of data is identified using the subset of the input register 810 and a portion of the lookup table, registers 820E-820H, and stored in the second register 840.

The most significant position of the input register 810, b7 in the example of FIG. 8, is communicated to a multiplexor 850, such as a SIMD based multiplexing operator, coupled to the first register 830 and the second register 840. Based on the most significant position of the input register 810, the multiplexor 850 retrieves data form the first register 830 or from the second register 840 and stores the retrieved data in a holding register 860. For example, if the most significant position, of the input register 810 has a logical high value, the multiplexor 850 communicates data from the first register 830 to the holding register 860. In the above example, if the most significant position of the input register 810 has a logical low value, the multiplexor 850 communicates data from the second register 840 to the holding register 860. While the example of FIG. 8 illustrates a 2:1 multiplexor 850 using the most significant position of the input register 810 to select an output, in other implementations the multiplexor 850 selects from a greater number of input using a greater amount of data from the input buffer 810.

A masking operation is then applied to the holding register 860 to identify a subset of data from the holding register that identifies the waveform to be applied to the input pixel during a subframe. For example, the masking operation identifies two bits of output for each input pixel stored in the input register 810 from an eight bit holding register 860. In the example of FIG. 7, a bit shift operator 870 shifts the two least significant positions of the input register 810 in a specified manner. For example, the bit shift operator 870 left shifts the least significant positions of the input register 810 by two. The output of the bit shifter and the holding register 860 are then input to an AND operator 890 and the output of the AND operator 890 is restored 892 to identify the waveform for application to different input pixels during the subframe. In other embodiments, however, a different masking operation is performed to identify a waveform using a different subset of the holding register 860.

The foregoing description of the embodiments of the present embodiment of invention has been presented for the purposes of illustration and description. It is not intended to be exhaustive or to limit the present embodiment of invention to the precise form disclosed. Many modifications and variations are possible in light of the above teaching. It is intended that the scope of the present embodiment of invention be limited not by this detailed description, but rather by the claims of this application. As will be understood by those familiar with the art, the present embodiment of invention may be embodied in other specific forms without departing from the spirit or essential characteristics thereof. Likewise, the particular naming and division of the modules, routines, features, attributes, methodologies and other aspects are not mandatory or significant, and the mechanisms that implement the present embodiment of invention or its features may have different names, divisions and/or formats. Furthermore, as will be apparent to one of ordinary skill in the relevant art, the modules, routines, features, attributes, methodologies and other aspects of the present embodiment of invention can be implemented as software, hardware, firmware or any combination of the three. Also, wherever a component, an example of which is a module, of the present embodiment of invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present embodiment of invention is in no way limited to implementation in any specific programming language, or for any specific operating system or environment. Accordingly, the disclosure of the present embodiment of invention is intended to be illustrative, but not limiting, of the scope of the present embodiment of invention, which is set forth in the following claims.

What is claimed is:

1. An electronic system for displaying pages on an electronic paper display device, the system comprising:

a memory storing a transition matrix and a waveform table, the transition matrix having a plurality of transition matrix pixels that represent a plurality of display pixels in the electronic paper display device; and a page transition display system coupled to the memory, the page transition display system comprising:

a subframe producer configured to:

process the plurality of transition matrix pixels in parallel to identify one or more waveforms from the waveform table for modifying the plurality of display pixels in the electronic paper display device associated with the plurality of transition matrix pixels by:

loading the plurality of transition matrix pixels into a plurality of positions in an input register;

generating data in a holding register by selecting the data from a lookup table based on at least two subsets of the plurality of transition matrix pixels loaded at different positions in the input register; and identifying the one or more waveforms from the waveform table using the data in the holding register; and generate one or more subframes associating the one or more waveforms with the plurality of transition matrix pixels, each of the one or more subframes including a part of a waveform for driving one of the plurality of display pixels in the electronic paper display device; and a subframe consumer configured to control a display subsystem that receives the one or more subframes from the subframe producer and generates control signals for the plurality of display pixels in the electronic paper display device corresponding to the plurality of transition matrix pixels using the identified waveforms.

2. The system of claim 1, further comprising a display subsystem coupled to the page transition display system, the display subsystem configured to receive the control signals, generate driving voltages based on the received control signals and apply the driving voltages to the plurality of display pixels included in the electronic paper display device corresponding to the plurality of transition matrix pixels.

3. The system of claim 2, further comprising:

a timing interface coupled to the display subsystem and to the electronic paper display device, the timing interface configured to receive the driving voltages from the display subsystem and determine a time when the driving voltages are applied to the plurality of display pixels in the electronic paper display device.

4. The system of claim 1, wherein the page transition display system comprises:

a committed palette list, the committed palette list comprising one or more frame regions that are being updated, the one or more waveforms for driving the plurality of display pixels in a display update region corresponding to a frame region, and at least one subframe and at least one cycle number of the waveform table at which the update to the display update region would be complete; and wherein the page transition display system is further configured to, once the control signals are generated, remove from the committed palette list the one or more frame regions and the one or more waveforms associated with the display update region.

5. The system of claim 1, further comprising:

a subframe buffer coupled to the subframe producer, the subframe buffer configured to receive the one or more subframes from the subframe producer, store the one or more subframes and send the one or more subframes to the display subsystem.

6. The system of claim 1, wherein the page transition display system is configured to identify the waveform associated with a transition matrix pixel by accessing an entry in the waveform table based on a subset of bits comprising the transition matrix pixel.

7. A method for modifying a plurality of display pixels in an electronic paper display device comprising:

responsive to receiving a first display request, determining whether a subframe buffer is full;

responsive to determining that the subframe buffer is not full, updating a subframe counter;

generating a first subframe associating one or more waveforms with a plurality of transition matrix pixels by processing the plurality of transition matrix pixels in parallel to identify the one or more waveforms from a waveform table for modifying the plurality of display pixels in the electronic paper display device associated with the plurality of transition matrix pixels, the first subframe including a part of a waveform for driving one of the plurality of display pixels in the electronic paper display device, wherein processing the plurality of transition matrix pixels includes:

loading the plurality of transition matrix pixels into a plurality of positions in an input register;

generating data in a holding register by selecting the data from a lookup table based on at least two subsets of the plurality of transition matrix pixels loaded at different positions in the input register; and identifying the one or more waveforms from the waveform table using the data in the holding register;

generating control signals associated with the one or more waveforms, the control signals identifying the plurality of display pixels in the electronic paper display device associated with the plurality of transition matrix pixels and driving voltages for application to the plurality of display pixels; and applying the driving voltages to the plurality of display pixels.

8. The method of claim 7, wherein generating the first subframe associating the one or more waveforms with the plurality of transition matrix pixels further comprises:

storing the first subframe in the subframe buffer.

9. The method of claim 7, further comprising:

determining whether the first subframe is the last subframe for modifying the plurality of display pixels in the electronic paper display device; and responsive to determining that the first subframe is the last subframe for modifying the plurality of display pixels in the electronic paper display device, monitoring for a second display request.

10. The method of claim 9, further comprising:

responsive to determining that the first subframe is not the last subframe for modifying the plurality of display pixels in the electronic paper display device, determining whether the subframe buffer is full;

responsive to determining that the subframe buffer is not full, updating the subframe counter;

generating a second subframe associating one or more waveforms with the plurality of transition matrix pixels by processing the plurality of transition matrix pixels in parallel to identify the one or more waveforms from the waveform table for modifying the plurality of display pixels in the electronic paper display device associated with the plurality of transition matrix pixels; and storing the second subframe in the subframe buffer.

11. The method of claim 7, wherein generating the first subframe comprises:

applying one or more single instruction multiple-data (SIMD) instructions to a vector including the plurality of transition matrix pixels to identify a waveform associated with each of the plurality of transition matrix pixels.

12. The method of claim 7, wherein the plurality of transition matrix pixels from a same image are processed in parallel.

13. The method of claim 7, wherein processing the plurality of transition matrix pixels further comprises:

applying a masking operation to the data in the holding register.

14. The method of claim 13, wherein the masking operation is based on a subset of the plurality of transition matrix pixels from the input register that is different from the at least two subsets of the plurality of transition matrix pixels used in generating the data in the holding register.

15. A computer program product comprising a non-transitory computer usable storage medium including a computer readable program, the computer readable program when executed by a processor causes the processor to:

determine whether a subframe buffer is full responsive to receiving a first display request;

update a subframe counter responsive to determining that the subframe buffer is not full;

generate a first subframe associating one or more waveforms with a plurality of transition matrix pixels by processing the plurality of transition matrix pixels in parallel to identify the one or more waveforms from a waveform table for modifying a plurality of display pixels in an electronic paper display device associated with the plurality of transition matrix pixels, the first subframe including a part of a waveform for driving one of the plurality of display pixels in the electronic paper display device, wherein processing the plurality of transition matrix pixels includes:

loading the plurality of transition matrix pixels into a plurality of positions in an input register;

generating data in a holding register by selecting the data from a lookup table based on at least two subsets of the plurality of transition matrix pixels loaded at different positions in the input register; and identifying the one or more waveforms from the waveform table using the data in the holding register; and generate control signals associated with the one or more waveforms, the control signals identifying the plurality of display pixels in the electronic paper display device associated with the plurality of transition matrix pixels and driving voltages for application to the plurality of display pixels.

16. The computer program product of claim 15, wherein to generate the first subframe associating the one or more waveforms with the plurality of transition matrix pixels, the computer readable program further causes the processor to store the first subframe in the subframe buffer.

17. The computer program product of claim 16, wherein the computer readable program further causes the processor to:

determine whether the first subframe is the last subframe for modifying the plurality of display pixels in the electronic paper display device; and monitor for a second display request responsive to determining that the first subframe is the last subframe for modifying the plurality of display pixels in the electronic paper display device.

18. The computer program product of claim 17, wherein the computer readable program further causes the processor to:

determine whether the subframe buffer is full responsive to determining that the first subframe is not the last subframe for modifying the plurality of display pixels in the electronic paper display device;

update the subframe counter responsive to determining that the subframe buffer is not full;

generate a second subframe associating one or more waveforms with the plurality of transition matrix pixels by processing the plurality of transition matrix pixels in parallel to identify the one or more waveforms from the waveform table for modifying the plurality of display pixels in the electronic paper display device associated with the plurality of transition matrix pixels; and store the second subframe in the subframe buffer.

19. The computer program product of claim 15, wherein to generate the first subframe, the computer readable program further causes the processor to apply one or more single instruction multiple-data (SIMD) instructions to a vector including the plurality of transition matrix pixels to identify a waveform associated with each of the transition matrix pixels.

20. The system of claim 1, wherein the waveform table is an indexed storage for the one or more waveforms, and wherein the indices in the waveform table are not permanently committed to a particular waveform and the indices are updated repeatedly with different waveforms for driving the plurality of display pixels in the electronic paper display device to a color.

* * * * *